United States Patent [19]

Rogahn

[11] Patent Number: 4,741,534

[45] Date of Patent: May 3, 1988

[54] MULTI-PICTURE PUZZLE APPARATUS

[76] Inventor: Dino J. Rogahn, 3737 E. Turney, Number 135, Phoenix, Ariz. 85018

[21] Appl. No.: 2,234

[22] Filed: Jan. 9, 1987

[51] Int. Cl.[4] ..... A63F 9/10

[52] U.S. Cl. ..... 273/157 R; 40/600; 40/907; 273/1 M; 335/302; 446/92

[58] Field of Search ..... 273/157 R, 118 A, 345, 273/1 M; 40/449, 600, 907; 335/296, 302; 446/92, 118

[56] References Cited

U.S. PATENT DOCUMENTS

| | | | |
|---|---|---|---|
| 2,041,030 | 5/1936 | Strotton | 273/157 R |
| 2,562,089 | 7/1951 | Fishlove | 273/345 |
| 2,665,912 | 1/1954 | Juran | 273/118 A |
| 2,984,489 | 5/1961 | Parlato | 273/157 R |
| 3,254,440 | 6/1966 | Duggar | 446/92 |
| 3,608,906 | 9/1971 | Odier | 273/157 R |
| 3,759,522 | 9/1973 | Hodan, III | 273/157 R X |
| 4,021,939 | 5/1977 | May | 273/157 R X |
| 4,051,607 | 10/1977 | Sullivan | 273/157 R |
| 4,307,886 | 12/1981 | Kemper | 273/157 R X |
| 4,448,418 | 5/1984 | McNeill | 273/345 X |
| 4,508,347 | 4/1985 | Shettler | 273/157 R |
| 4,586,714 | 5/1986 | Lenkoff et al. | 273/157 R |

FOREIGN PATENT DOCUMENTS

| | | | |
|---|---|---|---|
| 2123306 | 2/1984 | United Kingdom | 446/92 |
| 2128104 | 4/1984 | United Kingdom | 273/157 R |

*Primary Examiner*—Anton O. Oechsle

*Attorney, Agent, or Firm*—Don J. Flickinger; Jordan M. Meschkow

[57] ABSTRACT

A multi-picture puzzle comprises a plurality of cubes. A portion of a picture is carried on each side of the cube. Each cube has a spherical chamber therein. A ball is freely movable within the chamber and forms a magnetic relationship with a tray upon which each of the cubes is placed thus removably securing the cubes in place. Such cubes may be used as status indicators for indicating the existence of one of a plurality of conditions.

10 Claims, 1 Drawing Sheet

MULTI-PICTURE PUZZLE APPARATUS

BACKGROUND OF THE INVENTION

Field of the Invention

This invention relates generally to an article of manufacture, and more particularly to a multi-picture puzzle apparatus. More specifically, the invention relates to a magnetic multi-picture puzzle apparatus utlizing puzzle components of a novel construction.

The prior art is replete with board games and eductational puzzles that employ a plurality of blocks that can be arranged to produce a variety of patterns; e.g. U.S. Pat. Nos. 3,759,522; 4,177,305; 4,177,993 and 4,076,253. Furthermore, it is known, for example from U.S. Pat. Nos. 4,021,939 and 4,508,348, to provide a picture puzzle having a plurality of pieces each carrying a portion of a different picture on different respective sides. U.S. Pat. No. 2,041,030 describes a puzzle wherein each of the puzzle pieces is a polyhedron having dihedral angles other than 90°.

Various mechanisms have also been developed to facilitate the placement of puzzle pieces of the type described above. For example, the use of trays for holding the pieces is shown and described in U.S. Pat. Nos. 2,041,030; 2,984,489; and 4,021,939; and grip systems for defining areas in which puzzle pieces are to be located are disclosed in U.S. Pat. Nos. 3,759,522 and 4,586,714.

While the prior art arrangements have fulfilled their intended roles and functions in a more or less satisfactory manner, they have been less than desirable insofar as their ability to be utilized under difficult conditions such as while writing in an automobile or other moving vehicle or while reclining or lying down.

SUMMARY OF THE INVENTION

It is an object of the invention to provide an improved puzzle apparatus.

It is a further object of the present invention to provide a puzzle-piece of novel construction for use in multi-picture puzzles.

Still a further object of the present invention is to provide a multi-picture puzzle apparatus wherein each of the individual puzzle pieces are in the form of polyhedrons and are magnetically attracted to a base or tray.

Yet another object of the present invention is to provide an improved article of construction the purpose of which is to visually indicate one of a plurality of possible conditions.

In accordance with a broad aspect of the invention there is provided an article of manufacture, comprising a base; a least one polyhedron having an internal chamber therein; and first means freely movable within the chamber and magnetically attracted to the base for removably securing polyhedron to the base.

According to a further aspect of the invention there is provided a puzzle comprising a base and a plurality of polyhedrons for positioning on the base, each plurality having an intenal chamber therein, and having means freely movable within the chamber and magnetically attracted to the base for removably securing the polyhedron to the base.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT

Figure 1:
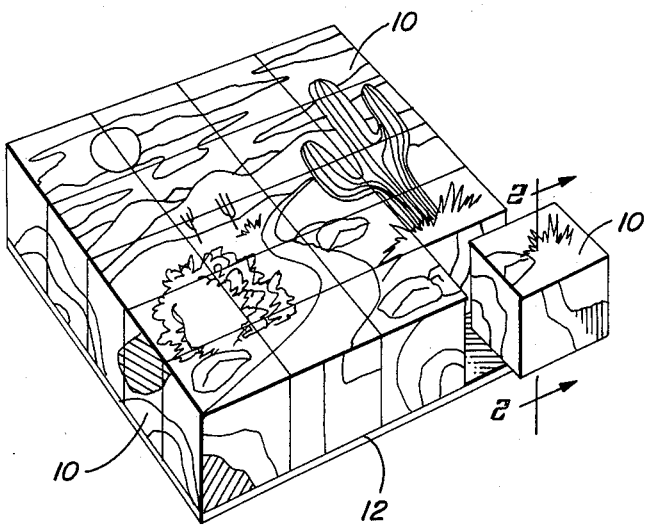
FIG. 1 is an isometric view of a multi-picture puzzle in accordance with the present invention.

Referring to FIG. 1, there is shown a multi-picture puzzle wherein a portion of each picture is carried on each side of a plurality of removable cubes 10. Since each cube has 6 sides, a total of 6 different pictures may be formed utilizing all the cubes in the well known matter. While cubes have been shown in FIG. 1 as comprising the elements of the puzzle, it should be clear that other forms of polyhedrons may be so utilized preferably, although not necessarily, polyhedrons having opposed parallel faces.

Each of the cubes 10 may be positioned on a base or tray 12. Base 12 is either magnetic or is of a matreial which is attracted by a magnet. In this manner, and as will be explained in more detail below, each of the cubes is magnetically attracted to base 12 and is thus secured such that the puzzle may be easily utilized under less than desirable conditions such as riding in a moving vehicle.

Figure 2:
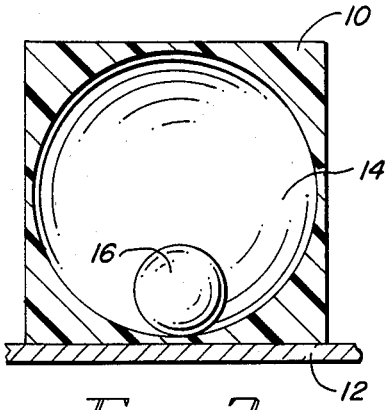
FIG. 2 is a cross-sectional view of one of the puzzle pieces shown in FIG. 1 taken along 2—2.

FIG. 2 is a cross-sectional view of one of the cubes utilized in FIG. 1 and taken along line 2—2. It should be remembered, however, that the cube is only one of many polyhedrons which may be utilized in this manner. As can be seen in FIG. 2, cube 10 which may be made of wood, plastic or other suitable material is provided with an interior spherical chamber 14 which houses freely movable ball 16 which is either magnetic or of a mateial which is magnetically attracted.

Thus, it can be seen that cube 10 will be secured due to the magnetic attraction between base 12 and ball 16. It should also be appreciated that this may be accomplished if base 12 is positioned vertically and furthermore, cube 7 may be secured to the underside of base 12 since ball 16 will always be magnetically urged against a wall of cube 10 adjacent base 12. This advantage of the inventive structure can be more appreciated in connection with the information or status board shown in FIG. 3.

Figure 3:
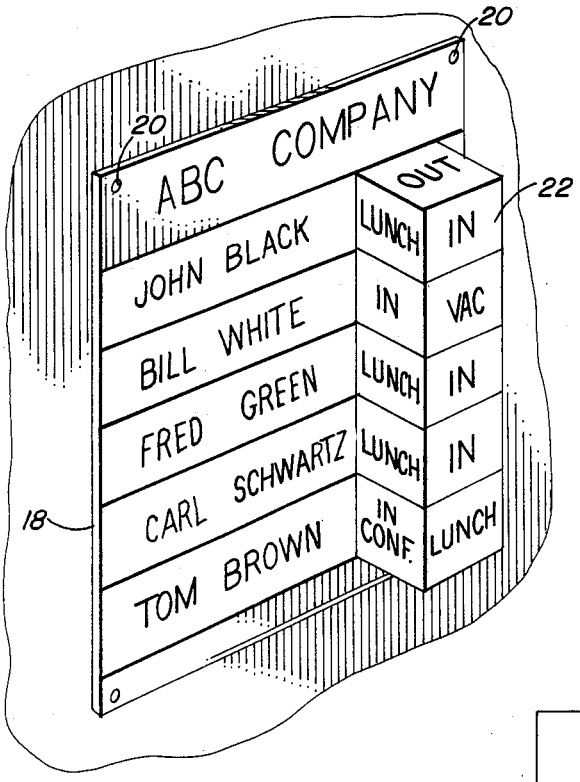
FIG. 3 is an isometric view of a status board utilizing the construction of the present invention.

Referring to FIG. 3 there is shown a ferromagnetic base 18 which may be vertically secured as by passing screws or nails through holes 20 into, for example, a wall. Base 18 has a front surface having information indicia thereon. That is, the name of a company (ABC COMPANY) appears at the top and is followed by a list of employee's names. A block 22 of the type shown in FIG. 2 is associated with each name. Each face of the block has indicia thereon indicating the location or status of that employee.

Figure 4:
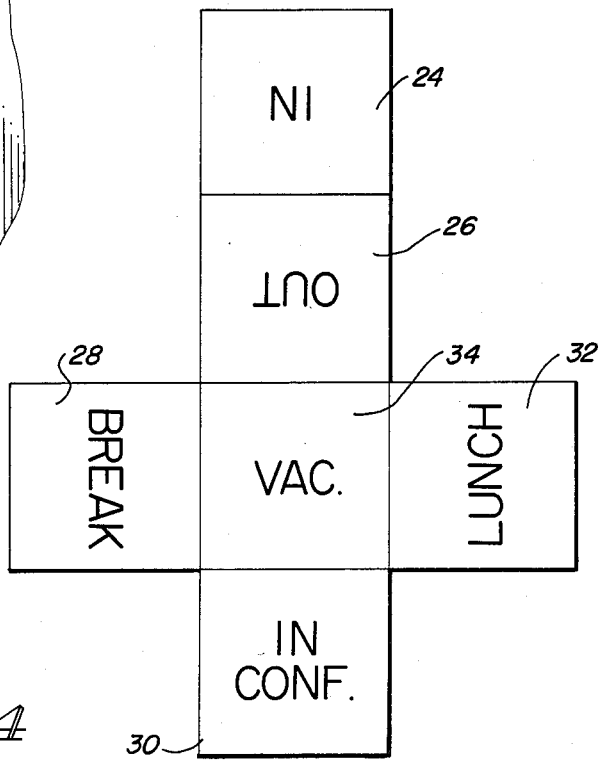
FIG. 4 is a plan view illustrating the information displayed on the six sides of each of the cubes shown in FIG. 3.

FIG. 4 illustrates the indicia which might appear on each face of the block. Face 24 indicates that the employee is "in" while face 26 indicates that the employee is "out". Faces 28, 30 and 32 indicate that the employee is on break, in conference or out to lunch, respectively. Finally, face 34 indicates that the employee is on vacation. Referring back to FIG. 3, it can be seen that Messrs. Black, Green and Schwartz are in, Mr. White is on vacation and Mr. Brown is out to lunch.

The above description is given by way of example only. Changes in form and details may be made by one skilled in the art without departing from the scope of the invention as defined by the appended claims.

I claim:

1. An article of manufacture, comprising:

a base;

at least one cube having a single spherical internal chamber therein; and a sphere freely movable within said chamber and magnetically attracted to said base for removably securing said at least one cube to said base.

2. An article according to claim 1, further comprising indicia on at least one side of said cube.

3. An article according to claim 1, wherein said base is magnetic and said sphere is of a ferromagnetic material.

4. An article according to claim 1, wherein said base is of a ferromagnetic material and said sphere is a magnet.

5. A puzzle comprising:

a base;

a plurality of cubes for positioning on said base each of said plurality having single spherical internal chamber therein, and each having a sphere freely movable within said chamber and magnetically attracted to said base for removably securing said cube to said base.

6. A puzzle according to claim 5, wherein each face of said cube carries a portion of one of a plurality of complete pictures.

7. A puzzle according to claim 5, wherein said base is a magnet and said sphere is of a ferromagnetic material.

8. A puzzle according to claim 5, wherein said base is of a ferromagnetic material and said sphere is a magnet.

9. An article of manufacture comprising:

a cube having single spherical internal chamber therein; and a magnetic ball freely movable within said chamber.

10. An article according to claim 9 further comprising indicia on at least one face of said cube.

* * * * *